United States Patent [19]

Mochizuki

[11] Patent Number: 4,753,489

[45] Date of Patent: Jun. 28, 1988

[54] BAG MOUTH OPENER

[76] Inventor: Junji Mochizuki, 15-5, Kurosuna 1-chome, Chiba-shi, Chiba-ken, Japan

[21] Appl. No.: 2,406

[22] Filed: Dec. 12, 1986

[51] Int. Cl.[4] ..... B65D 33/00

[52] U.S. Cl. ..... 383/33; 383/68

[58] Field of Search ..... 383/33, 68

[56] References Cited

U.S. PATENT DOCUMENTS

| | | | |
|---|---|---|---|
| 3,782,601 | 1/1974 | Krawagna | 383/33 |
| 4,027,819 | 6/1977 | Herrera-Gutierrez | 383/33 |
| 4,210,249 | 7/1980 | Holmes | 383/68 |
| 4,460,091 | 7/1984 | Hain et al. | 383/68 |

*Primary Examiner*—Willis Little

*Attorney, Agent, or Firm*—Lowe, Price, LeBlanc, Becker & Shur

[57] ABSTRACT

A disposable bag mouth opener is equipped to a bag (1) in a stage of charge and packing or in a stage of purchase by a consumer, the bag being sealed after charge of contents. This opener has a simple design comprising a bag attachment plate (2) and a holding device (3) for hold. The bag attachment plate (2) is provided with a mouth end (20) and a plate section (22) having characteristic of contact and separation and forming a cause of contact and separation of inner surfaces of the mouth end (20). The holding device is provided with an inner wall narrow portion (30) having a design which can hold and support the mouth end (20). The attachment plate (2) is attached by suitable means to the bag (1) at a section of bag mouth level of a projecting edge surface (10) previously provided or additionally provided on the bag (1) in the form of a projection. The bag mouth is obtained by cutting off a cutoff correspondence section (100) of the edge surface (10), and the degree of opening and closing thereof can be repeatedly and freely adjusted mainly by manipulating the attachment plate (2) with hands and fingers. The bag mouth can be closed continuously at any time by providing the holding device (3) to the mouth end (20).

1 Claim, 7 Drawing Sheets

FIG.1 <A>
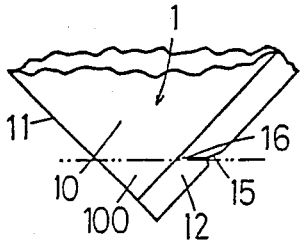
FIG.1 <B>
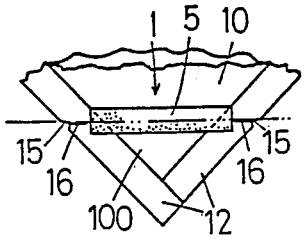
FIG.1 <C>
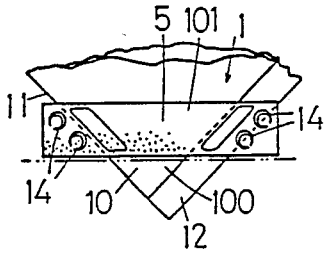
FIG.1 <D>
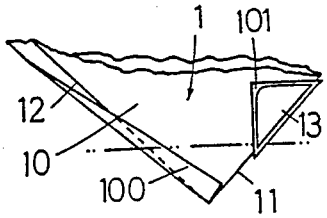
FIG.1 <E>
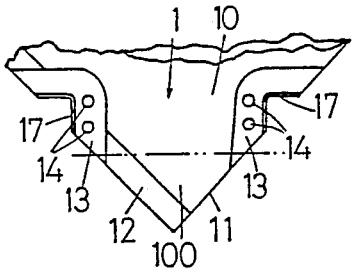
FIG.1 <F>
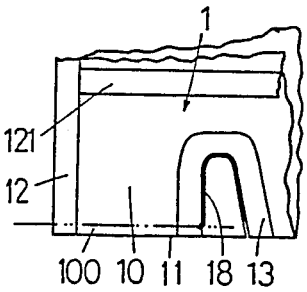
FIG.1 <G>
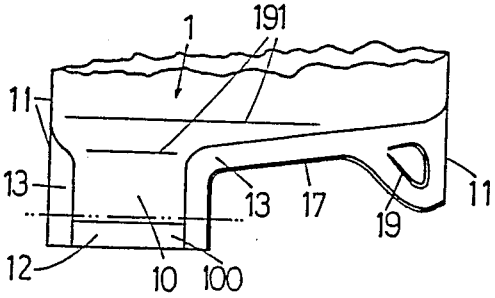
FIG.1 <H>
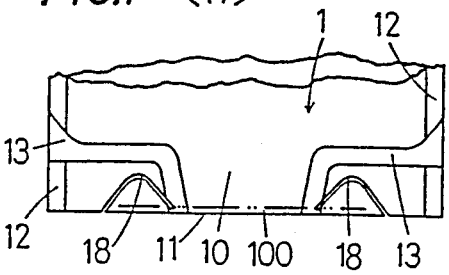

FIG.1 <I>
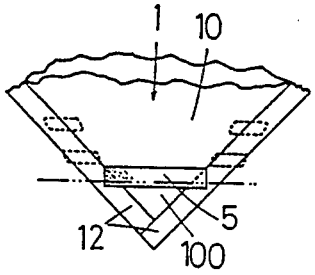
FIG.1 <J>
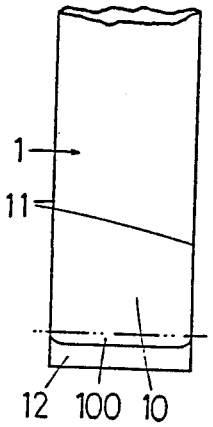
FIG.1 <K>
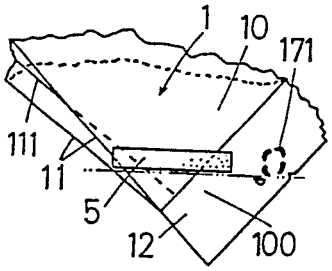
FIG.1 <L>
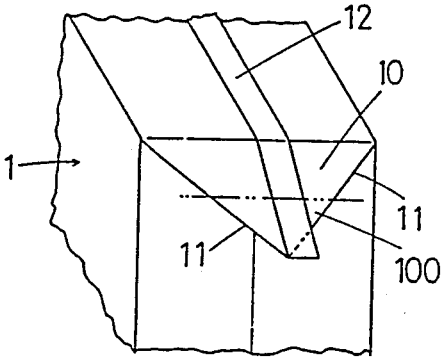
FIG.1 <M>
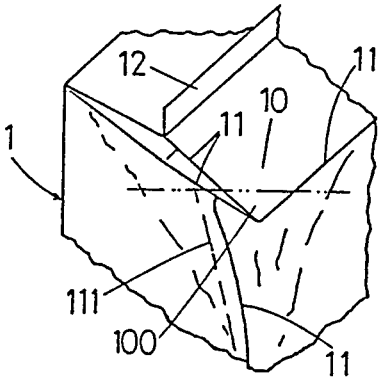

FIG. 2 <A>
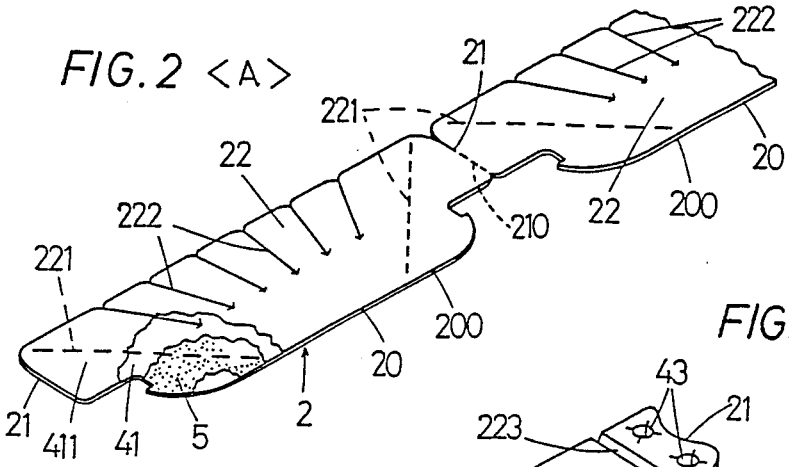
FIG. 2 <B>
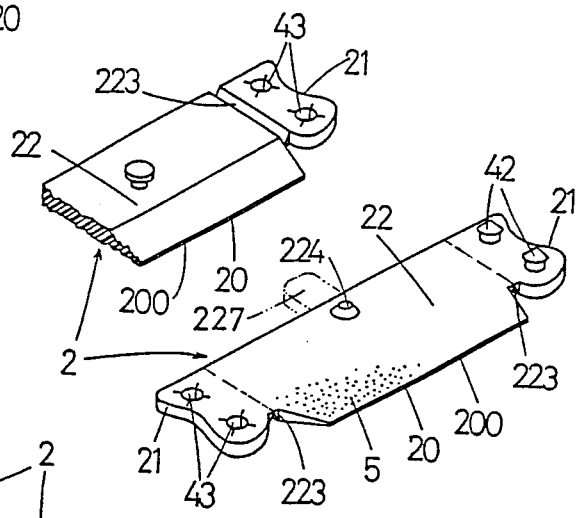
FIG. 2 <C>
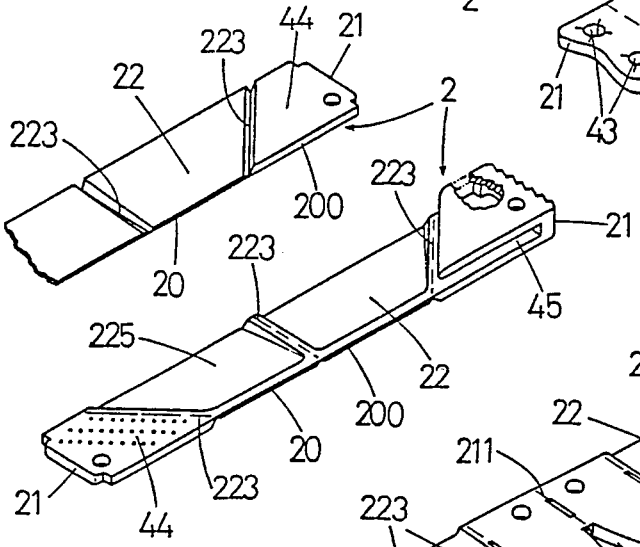
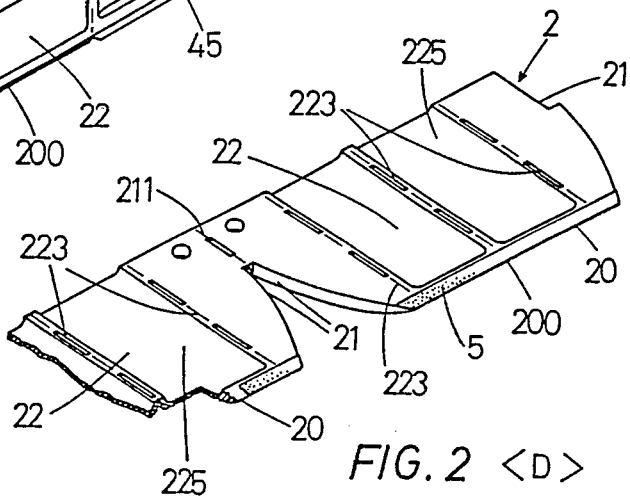
FIG. 2 <D>

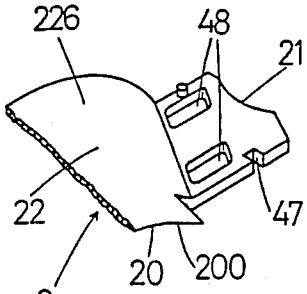
FIG. 2 <F>
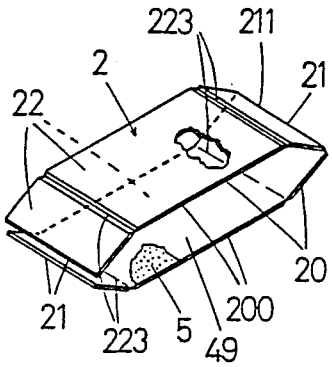
FIG. 2 <E>
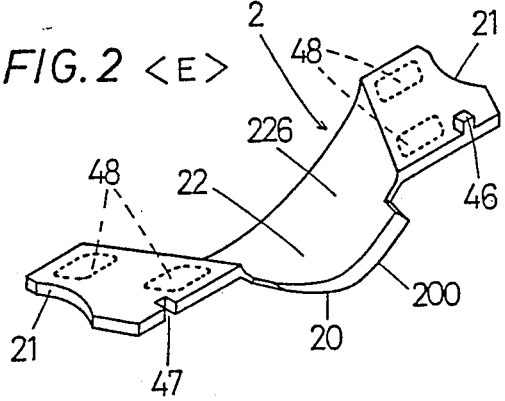
FIG. 2 <G>
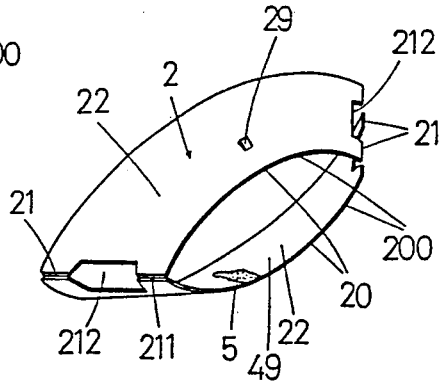
FIG. 2 <H>
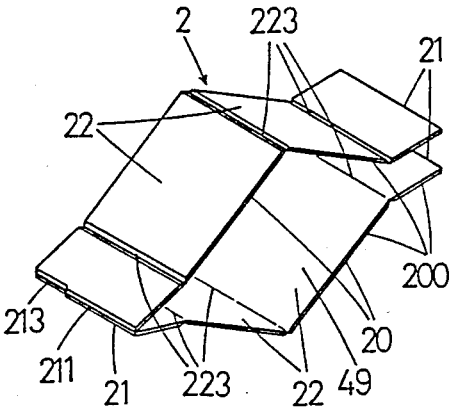
FIG. 3 <A>
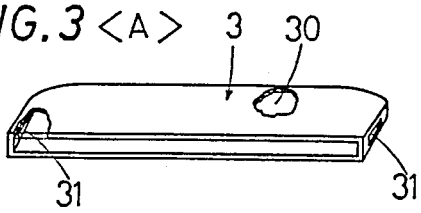
FIG. 3 <B>
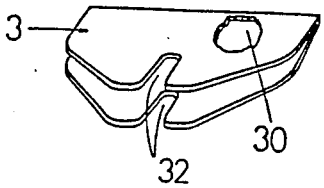
FIG. 3 <C>
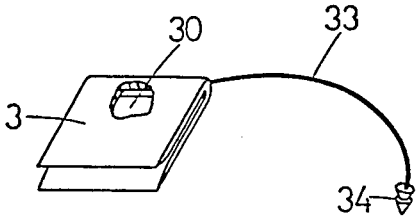

FIG. 3 <D>
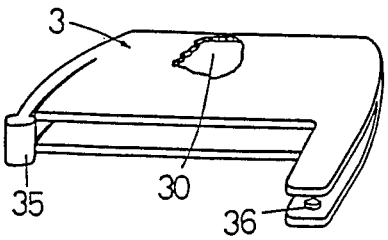
FIG. 3 <E>
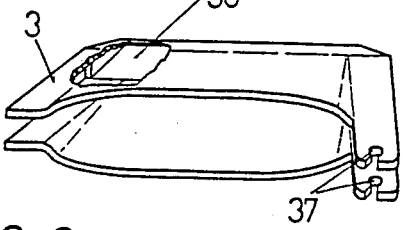
FIG. 3 <F>
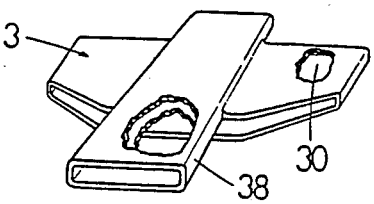
FIG. 3 <G>
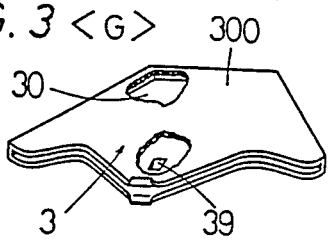
FIG. 3 <H>
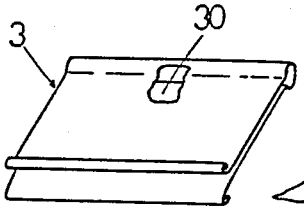
FIG. 4 <A>
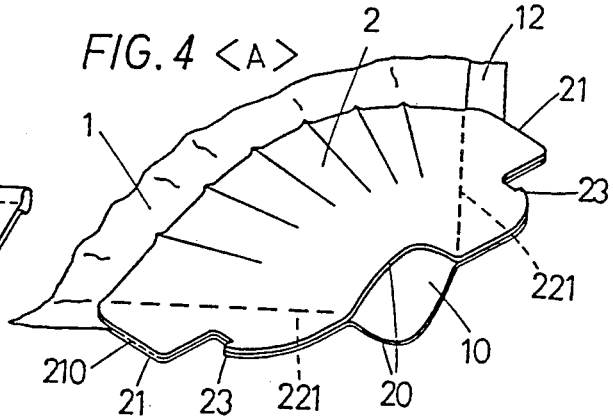
FIG. 4 <B>
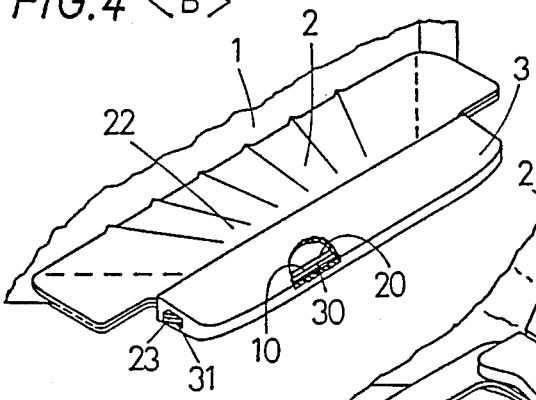
FIG. 4 <C>
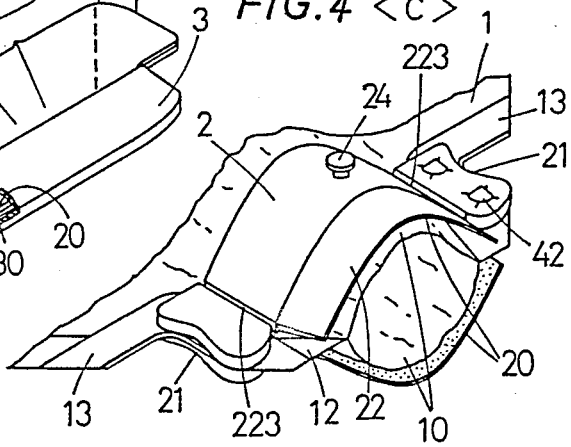

FIG. 4 <D>
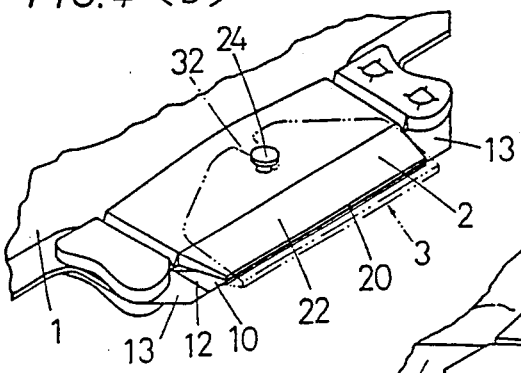
FIG. 4 <E>
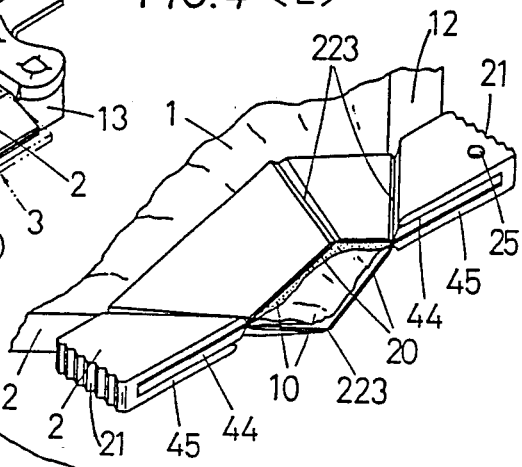
FIG. 4 <F>
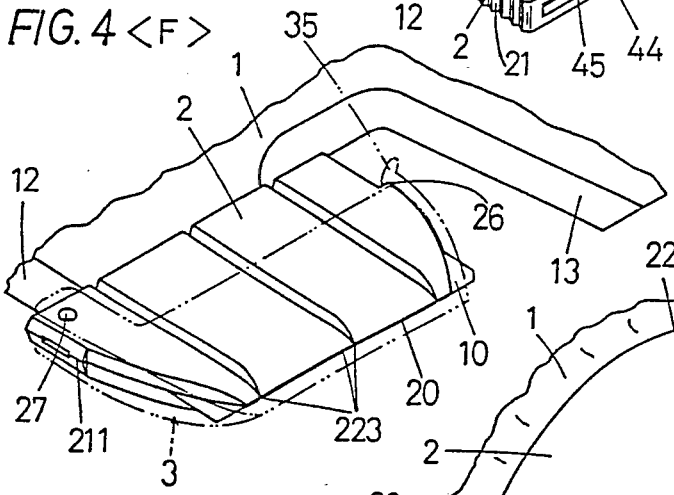
FIG. 4 <G>
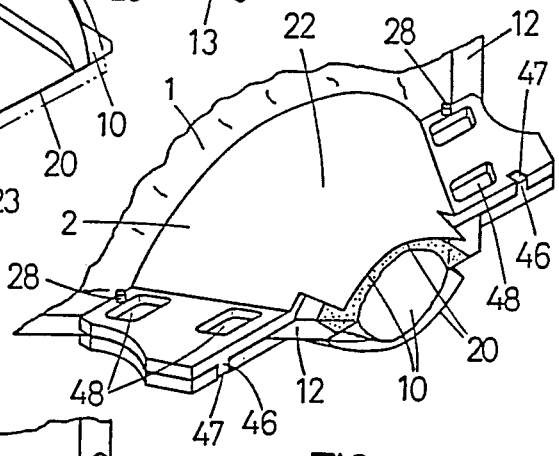
FIG. 4 <H>
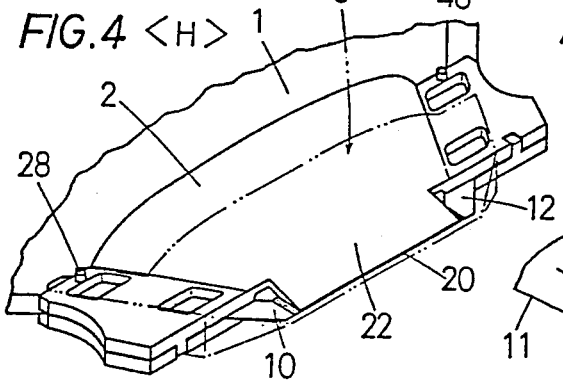
FIG. 4 <I>
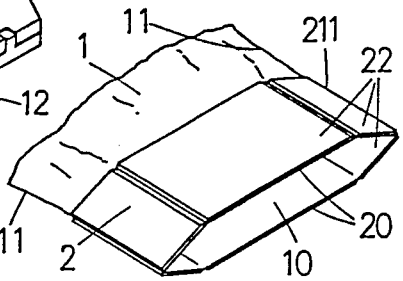

FIG. 4 <J>
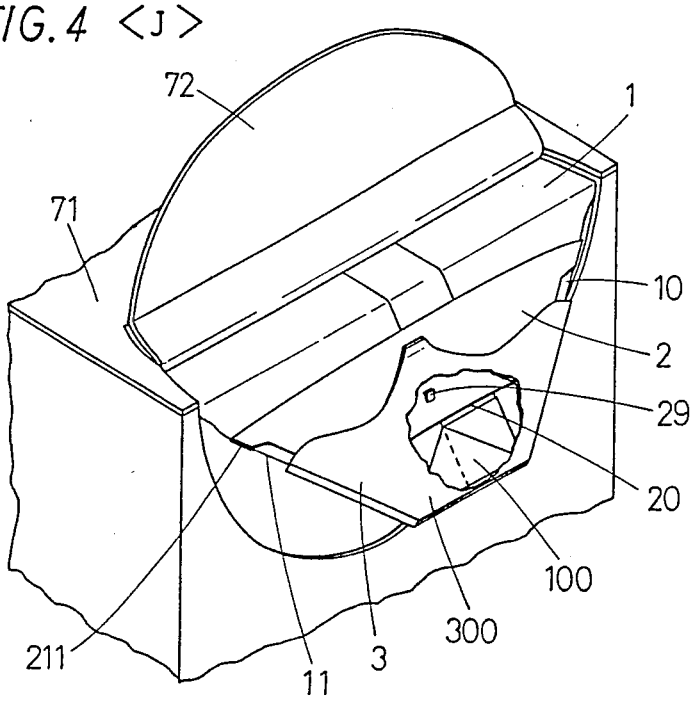
FIG. 5
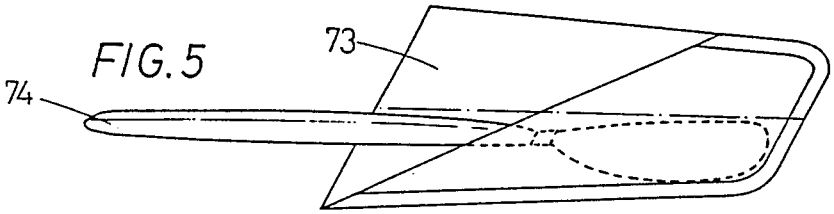
FIG. 6
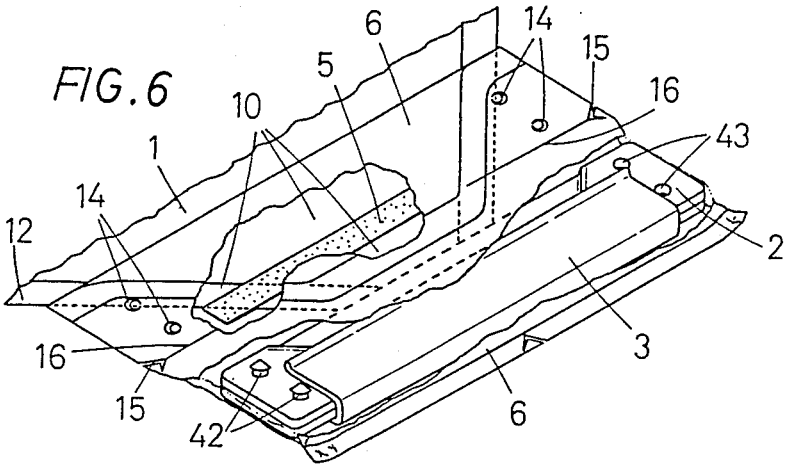

BAG MOUTH OPENER

TECHNICAL FIELD

This invention relates to a novel and simple equipment able to change a mere bag to a convenient container allowing contents to be removed little by little, the equipment being excellent in incidental economy and also remarkably increasing the utility of a bag when the equipment is provided to the bag.

BACKGROUND ART

The technical level of disposable bag containers belonging to so-called flexible packings, having mouths for removing little by little, and being sealed after charge of contents is constituted by structures having a bag (specifically, various plastic pouches, bag in cartons, internal bags in boxes, and the like) formed by sealing appropriate peripheral edges of a thin sheet or film made of flexible packing material (normally flexible compound packing material), a separately-made outlet mouth inserted into a hole in a bag surface or between the sealed surfaces and sealingly and integrally attached thereto, and a cap or plug (shortened to simple a "cap") for sealingly closing the mouth.

This bag container has special merits, such as economy due to its base composed of a bag (that is, low costs of materials, manufacture, and transportation), custody characteristic before charge, non-air-intake discharge characteristic during squeeze removal (in the case of mucous or past contents), easiness in degassing, characteristic of press-breaking of hygroscopic solidified material from outside (in the case of powder or grain contents), and disposal characteristic after use, which hard cubic containers do not have. Meanwhile, in comparison with a bag having a mere bag mouth, the mouth and the cap are convenient and thorough in preservation (specifically, in sealing of the bag for prevention of degration, change of scent, change of color, ingress of dust, or the like) of unused remaining contents. In addition, while the bag mouth is flexible and unstable and is inconvenient in handling, the mouth is better since the mouth serves as a support which stabilizes the container when the contents are removed little by little, when additives are injected, or when the cap is removed. On the other hand, since the mouth and the cap involve drawbacks and defectivenesses as described below in [1]–[10], containers of such a kind have hardly come into wide use except the case of liquid contents

[1]. Engagement of the mouth needs to be performed during a bag manufacturing step, so that at least the conventional bag manufacturing step is obliged to be changed or supplemented virtually (specifically, even when content charging and sealing steps are the same as conventional steps, the mouth needs to be inserted into the bag and be connected during the bag manufacturing step). Since the mouth has a large region which comes into direct contact with the contents, close consideration is necessary beforehand in mutual safety adaptability.

[2]. The mouth must be in perfect sealing connection with the bag throughout the entire periphery (specifically, for the purpose of preventing the contents from leaking and maintaining the airtight and watertight characteristic of the container during transportation and use, the entire peripheral surface of the mouth and the insertion surface of the bag must be in perfect sealing connection).

[3]. In the combination of the mouth and the cap, the sealing closure of the mouth and the prevention of unwanted opening of the cap by suitable means are necessary (specifically, for the purpose of preventing leakage and unwanted discharge of the contents during transportation: the accuracy of the sealing contact between the contacting curved surfaces of these two members needs to be increased and the mouth and the cap must be screwed or fitted to each other; a separately made internal cap must be closely fitted within the mouth; an internal cap must be provided integrally within the mouth; a cap seal must be fitted around or attached to the closing cap; or the container must be packed individually).

[4]. The mouth connected to the hole of the bag forms no small useless space during transportation (specifically, only the mouth projects outward from the outer surface of the bag, so that many spaces are formed around it).

[5]. In the case of mucous or paste contents, even when discharge is suspended, the remainder in the cap prevents the mouth from being closed immediately (accordingly, before the cap is closed, the remainder must be removed). In the case where the removal is performed with fingers, hands, or napkins and it is necessary to prevent the mouth from being polluted with bacteria, the fingers, the hands, or the napkins must be disinfected or cleaned and dried beforehand, and further clearance work is necessary.

[6]. In the case of powder contents, grain contents, tablet contents, flake contents, or small lump contents, when the mouth clogs due to their internal friction during discharge, the restart of discharge is liable to fail (specifically, upon the restart, shock must be offered to the contents from outside so that the contents tend to scatter undesirably).

[7]. In the case of contents other than liquid, the mouth makes adjustment of the quantity of discharge difficult (specifically, in addition to the degree of downward facing of the mouth, it is possible to perform rough adjustment, that is, the application of pressure or vibration to the contents).

[8]. In the case of fluid contents other than liquid of low viscosity, the mouth makes a small quantity of discharge to a preset place difficult; and especially in the case of mucous contents, after the discharge, droppings from the edges occur so that pollution is induced (specifically, when the mouth is forced to face downward, the contents spread along the arcuate mouth edges and a large quantity of the contents is discharge; in the case of mucous contents, when the mouth is force to face upward to stop the discharge, the remaining droplets in the mouth edges move outward and fall).

[9]. The mouth connected between the seal surfaces of the bag is inconvenient for discharge or large quantity materials or solid materials, continuing discharge having a less posibility of clogging of the mouth, or injection of additives which a large mouth can suit (It should be noted that the mouth is just a small mouth in view of the consideration of transportation or the balance of design, or is virtually a small mouth in the form of an elongated distorted circle extending along the seal).

[10]. Even when the contents adhere to the inner walls and solidify so that the diameter of the mouth is reduced, the small mouth makes it difficult to remove them easily at any time (accordingly, the solidified materials must be removed by suitable tools).

For practical use by comsumers, a screwed mouth of a general cubic container, especially in the case of contents of less fluidity and a frequently used container, tends to remain not sealingly closed and roughly closed. The background of this includes consciousness that even in the case of rough closure, the gap is charged with the remainder or free air communication to the exterior is prevented if the gap is not charged with the remainder, so that sealing closure is unnecessary. However, in general, it is said that this is an escape from obstacles (such as pollution of the base of the mouth, the fingers, and the hands with the remainder after the discharge, the removal of the solidified materials obstructing the sealing closure, or a long time necessary to open the cap) involved with sealing closure. Accordingly, it is known that consumers notably have consciousness to desire cheap and simplicity, and as a result of the reflection of this, even in the case of cubically formed containers for liquid, there are many fitting caps of the easily opening and closing type.

Meanwhile, for manufacturers in this field, devices and means for utilizing an economical bag and changing it to a convenient bag container are desired sincerely, but good results have not yet been obtained because they are swayed by conventional and fixed ideas that a bag container is originally a thing which has a bag, a mouth of a conventional design sealingly fixed to the bag, and a cap. This invention achieves such technical tasks with an extremely simple equipment.

Accordingly, in view of the above-mentioned consciousness of consumers, an object of this invention is to provide a novel and simple bag mouth opener which solves the above-mentioned drawbacks and defectivenesses [1]–[10] related to the mouth and the cap in the prior art and which premises that it is equipped to the bag.

DISCLOSURE OF THE INVENTION

In summary of this invention for achieving the above-mentioned object, a bag is sealed after charge of contents. The bag has a projecting edge surface which is made flat. On both outer surfaces of this, there is an assumed bag mouth level portion, immediately above which a bag mouth opener is provided. A mouth end with a thin wall is provided at one edge of each of the two which has a length greater than the width of a section of the level portion corresponding to the bag mouth. Plate sections having characteristic of contact and separation are provided in a region between the mouth end and both sides of the two. A bag attachment plate is designed so that at least the above-mentioned mouth ends can mutually match easily, that the above-mentioned plate sections are opposed to mutually match the mouth ends and the inner surfaces of the plate sections can mutually separate due to their separation characteristic, and that at least portions of the inner surfaces near the mouth ends can mutually contact due to their contact characteristic. A holding device is provided which has an inner wall narrow portion designed so that the above-mentioned inner surfaces near the mouth ends can be located immediately above the above-mentioned bag mouth correspondence section and can remain in closing contact. When the bag mouth opener for the bag is used, the above-mentioned section immediately above the level portion and the inner surface of the attachement plate are connected in the form of a sigle overlap at least at the both ends of the section immediately above the level portion by a suitable attachment means.

Major embodiments of a lower conception included in the above-mentioned summary are as follows.

A projecting edge surface (shortened to "edge surface" hereinafter) is a portion adjacent to a corner defined by previously provided edges, a portion defined by provided edge formed by sealingly attaching inner surfaces of the both sides of the former portion, a single seal edge portion, or a single folded edge portion, a portion defined by the provided edge and the previously-provided edge, one of the above-mentioned projecting portions reinforced by an attached chip which is thin, strong, and flexible, or the like. The thinness of the wall of the mouth end results from the thinness of the bag attachment plate (shortened to "late" hereinafter), or from the absence of at least the outer or inner edge of the mouth end due to taper, circular, bevel processing, or the like. The plate with the contact and separation characteristic (shortened to "plate") is a portion which basically has the necessary ability of maintaining a shape, which can project on the side of the outer surface of the plate in a direction toward the mouth end (including an extended line along the mouth end), and which has elasticity, partially foldable characteristic, foldable elasticity, elastic flexibility, elasatic foldable characteristic, or partially foldable flexibility, or a similar portion which has two or more of these characteristics. The design allowing the mouth ends to mutaully match easily is a connection design in which at least one sides are foldably connected at a hinge texture and at least the mouth ends are mutually symmetrical with respect to this side, a connection design in which at least one ends of one side edges are mutually connected at a folded hinge texture and the mouth end takes the form of a slit and is symmetrical, a connection design in which at least one ends of other side edges are mutually connected at a hinge texture and is symmetrical, a separated design in which the whole of the plate has a common shape, a separated design in which a width between one side edge and other side edge is uniform, a separated design provided with matching guide matching the mouth ends mutually, or the like. Designs of upper and lower inner wall surfaces of the wall narrow portions (shortened to "narrow portion") and both outer surfaces of the plate are designs allowing at least parts of the upper and lower inner wall surfaces and the both outer surfaces of the plate (the mouth ends are in contact) can mutually contact for the hold, designs in which both of the two (that is, the inner wall surfaces and both the outer surfacs) are in the form of surfaces, designs in which one of the two and the other facing in the direction along the mouth end or in the direction toward the mouth end have recesses (preferably in the form of channels) respectively for pressure concentration and stopper, projection designs (in the form of ribs), projection designs (also in the form of ribs) in which only one of them facing in the direction along the mouth end or in the direction toward the mouth end is used for pressure concentration, or the like. The attachment means is means which connects the plate and the edge surface and which is appropriately selected from adhesion, cohesion, fitting, clamp, melting attachment, holding attachment, sewing attachment, or the like. The holding device for the hold (shortened to "holding device") and the plate are holdably connected, or have connecting means, or are separated.

In the case of the device of this invention is equipped to the bag, the method of use, the operation, and advantages (1)–(10) are as follows.

A bag mouth for discharge of contents is formed by cutting a portion of edge surface corresponding to a mouth end (that is, cutting and removing a portion of edge surface corresponding to cut and removal), regardless of whether a packing described hereinafter is present or absent. During contact between inner surfaces on the side of the mouth end as described hereinafter, the bag mouth is allowed to essentially agree with the mouth end or to be slightly exposed from the mouth end. The bag mouth may be provided between the inner surfaces on the side of the mouth end in the case of solid contents or in the case where the inner surfaces and the edge surface on the side of the bag mouth are entirely in sealing contact. The bag mouth can be opened by pressing both sides of the plate (after the holding device is removed), forcing (squeezing) the contents toward the bag mouth, relieving pressure on both outer surfaces of a plate section in the case where the plate section has self separation characteristic resulting from its own elasticity, or combining the above-mentioned actions to allow the inner surfaces of the plate section separate. The mouth end and the bag mouth around the opening, and also a packing described hereinafter have thin walls. The degree of opening and closing of the mouth end can be varied by adjusting alternately press of both sides of the plate and press of the plate section. Both ends of the edge surface has a sharp grooved shape in which a region to the bag mouth or the edge of the mouth end is V-shaped in such a manner that both the ends of the edge surface do not excessively separate. Stop of the discharge is performed by moving the bag mouth upward to return the contents in the case of low viscosity liquid contents, powder contents, grain contents, and solid contents, or by pressing both the outer surfaces of the plate section and contacting the inner surfaces on the side of the mouth end in a closed manner with an attitude facing downward in the discharge falling so that the inner surfaces of the edge surface on the bag mouth become into mutaully sealing contact in the case of mucous or paste contents. The continuously closing of the bag mouth is completed by forcing the holding device from the mouth end and partially or entirely holding both the outer surfaces of the plate section at the narrow portion so that the edge surface is moved into sealing contact under pressure. The region of the sealing contact of the inner surface on the side of the bag mouth is widened by the shape maintaining characteristic of the plate even when the pressed region of the outer surface of the plate section is partial. Under this sealing contact condition, since the plate is contacted in the form of a single overlap at both ends of the edge surface, useless overlap of the bag mouth surface which causes a gap does not occur so that the edge surface is made flat. Under the above-mentioned hold condition, the plate and the holding device are wholly made flat, since there is neither extreme projection nor protrusion from the surface and the peripheral edge of the bag.

Advantages in comparison with the above-mentioned matters [1]–[10] are as follows. (1). The attachment of the plate does not need a change of the present bag manufacturing step, so that mere additional countermeasure is sufficient (specifically, after completion of bag manufacture, direct attachment to the outer surface of the bag is enabled). Since it is sufficient that the mouth end is isolated from or slightly contacted with the contents, close consideration on the mutual safe adaptability is unnecessary. In addition, the plate can be attached to the outer surface of the bag, and also can be appropriately arranged and provided to the bag with ease, since it has a design which the mouth end can easily match. (2). It is unnecessary to seal the area of the attachment between the plate and the bag (because the bag is already sealed in itself). (3). The combination of the plate and the holding device does not need any equipments for preventing leakage and discharge during transportation (because the bag is in a sealed state until the bag mouth is formed). It is sufficient that the inner surfaces on the side of the mouth end contact mutually in mere flate surfaces when the plate section is pressed, and they are supplemented by the thickness of the wall of the edge surface extending between the inner surfaces even if the accuracy of the flat surface is inadequate. (4). The held plate and the holding device cause useless space, formed during transportation, to be small (because they ar made flat in the direction along the surface of the bag and can be attached while lessening projection from the peripheral edge of the bag). (5). Even in the case of mucous contents or paste contents (for example, honey, molasses, oils of various kinds, miso, butter, jam, catchup, mayonnaise, bean paste, raw cream, yoghurt, paste medicine, paste, tooth paste, liquid cleaning material, caulking, makeup and beauty creams of various kinds, makeup clay and paraffin, paste bloom, industrial mucous and paste basic materials, or the like), the plate allows the bag mouth to be closed immediately upon stop of the discharge (specifically, when the plate is pressed under the conditions where the contents fall, the contents are easily cut at the pressed inner surface on the side of the mouth end and are difficult to adhere thereto due to the thin walls of the mouth end and the bag mouth, so that the contents can immediately fall spontaneously by their weights or can be immediately dropped by application of weak vibration after the cut and that the surface of the cut at the mouth end becomes a extremely thin line and thus the holding device can be provided without cleaning the mouth end). Since the mouth end has a thin wall, it does not take a long time and it is easy to insert mutually the mouth end and the holding device prior to the provision of the hold. (6). In the case where the contents clog the bag mouth and accumulate, the plate prevents a mis-operation upon the restart of the discharge (specifically, if the plate is pressed or pressurized to change the shape of the bag mouth in the accumulated condition, the balance of the accumulation is broken and the discharge restarts spontaneously). (7). The plate allows easy adjustment of the quantity if discharge (specifically, the opening of the mouth end can be finely changed by manual adjustment of the press and pressurization of the plate which can be easily performed together with visual confirmation, so that the adjustment is easy, in cooperation with the degree of downward facing of the bag mouth or the condition of swinging out or squeezing out). Since the plate is connected in the form of a single overlap at the both ends of the edge surface, one sides of the two do not vibrate mutually but remain close to each other and thus fine adjustment is enabled with a single hand during the press and pressurization. Furthermore, since the wall of the mouth end is thin, it is easy to see the condition of the contents immediately after the discharge. (8). In the case of the plate, a small quantity of the discharge to a preset place is easy and the pollution by the fall from the edge is little (specifically, if the contents are guided along a flow path composed of the previously-mentioned grooved sharp edge surface or the edge surface extending along the portion of the mouth end which is sharply folded or curved, discharge little by little in a preset direction is enabled, and further even if the mucous contents are stopped by directing upward in place of the stop of the discharge with the downward facing, the flow path is sharp and the wall of the mouth edge is thin so that the remaining droplets in the mouth edge tend to be returned easily by the surface tension and thus the liquid cut is sufficient). (9). The plate can be adapted to the discharge or the injection which needs a large mouth (because the mouth end is immediately deformed into a virtually large mouth by the press of both the sides or the release of the plate from the pressure). (10). In the case of the plate, even if the contents solidify at the inner surface of the edge surface on the side of the bag mouth, they can be easily removed at any time (specifically, since the inner surfaces on the side of the bag mouth are sealingly contacted by the hold, there is hardly a space allowing the contents to remain and thus the solidified quantity is a small, and further if the outer surfaces of the plate section are repeatedly pressed and the inner surfaces are mutually contacted under pressure, the solidified material can be removed without using any tools). Even in the case of hygroscopic or deliquescent contents, since the wall of the mouth edge is thin, the solidification is almost impossible there as long as there is no adhesion of water.

Other restrictive embodiments capable of improving the performace of the device of this invention and their individual advantages are as follows.

(11). In the case of the plate section having an easy separation characteristic induction design in which the two inner surfaces of the plate section lie partially or entirely outward of a level of the inner surfaces on the side of the mouth end during contact (for example, a recessed shape in the form of a groove, a recessed shape in the form of a hollow, a recessed shape in the form of a shell, a recessed shape foldable or flexible due to the own elasticity of the plate during the press release, or a recessed shape of flexible or foldable characteristic involved with the inner surfaces of the plate section by their self or the mutual abutment between the projections on the other side edge), since the action of the press at the both sides or the action of squeezing out the contents is guided toward the outer surface as it is (even with unstable manipulation with a single hand), the start of the separation of the plate section is extemely smooth. (12). In the case where between the inner surface of the plate section on the side of the mouth end and the outer surface of the edge suraface on the side of the bag mouth (including these inner surface and the outer surface by their self) there is provided a flexible or foldable thin packing (for example, the case where a suitable material selected from independent foam type foam material of a high molecular weight, rubber or other elastic material of a high molecular weight, unwove cloth, wove cloth, hair, or the like having the packing ability is coated on the inner surface on the side of the mouth end or the outer surface on the bag mouth or a thin sheet of similar material is lined, the case where a similar sheet is provided in the form of a pad between the inner surface on the side of the mouth end and the outer surface on the side of the bag mouth, or the case where at least the mouth end is made of a simialr suitable material), or in the case where flexible charge materail or adhesive for fixing the plate is placed on the thin wall surface of the outer surface on the side of the bag mouth, the degree of sealing in the sealing contact between the inner surfaces of the bag mouth can be increased in cooperation with the pessure by the hold and airtight or watertight structure can be provided to the bag. (13). In the case of the sharp mouth end or the mouth end where the inner surface of the mouth end is in thin contact, the pressure concentrates so that it is easier to cut the contents by the press. (14). In the case of the sharp mouth end, during the formation of the bag mouth, if the plate section is pressed and the edge surface is held and further a shearing force along the mouth end is applied to the section corresponding to the cut and removal, stress concentrates and it is relatively easy to cut the edge surface with hand fingers only. (15). In the case of the mouth end having self lubrication characteristic (that is, the mouth end made of synthetic resin, such as polyehylene, polyacetal, polyamide, and fluorine, or the mouth end coated with such resin), the characteristic of adhesion to the contents is almost null and therefore the cut is exteremely excellent. (16). The inner surface of the mouth end with the plate section having elasticity can possess the characteristic of self contact or self separation, so that it is easier to handle. (17). In the case of the narrow portion of the inner wall having spring elasticity, the space allowability for the thickness of the plate section on the side of the mouth end is increased. In addition, when a fixed portion of the edge surface is provided with a thin, strong, and flexible attachment chip, back reinforcement of the portion and expansion and security of the fixed portion are possible.

The following embodiments in which the device of this invention is applied involve obstacles respectively.

In the case where a flat plate is directly, entirely, and sealingly fixed to the inner surface of the edge surface in place of the fixation to the outer surface of the edge surface, the previously-mentioned advantages (1) and (2) disappear, and further even when the both sides are pressed, the edge surface covering the plate section is strained and thus the mouth end is not separated sufficiently. In the case of the above-mentioned entire sealing fixation is replaced by partial fixation, the liquid contents surely enter the gap between the plate and the edge surface and solidify and thus obstruct the sealing closure of the bag mouth, and additionally the bag mouth is turned up and is overlapped during the hold. In the case where a cap is fitted to the outer surface of the mouth end whose inner surfaces are in separated states or to the inner surface in place of the hold by the holding device, the advantage (2) disappears, and further the mouth end deforms so that the operation of this fitting takes an extremely long time and additionally close fitting conditions are almost impossible. In the case where the bag is replaced by a molded flexible bag or semi-rigid bag and where the wall of the bag immediately above the portion corresponding to the bag mouth is thickened by integral formation or by folding and overlapping the edge surface of the above-mentioned bag edge surface to form a substitute for the plate, the advantage (1) disappears an further the step of forming or the stop of manufacturing the bag is made complicated, and additionally the bag or the material of the bag is limited. In the case where, in place of the holding device, a belt-shaped fitting chuck composed of the combination of a rib and a channel is sealingly attached to the both inner surfaces of the edge surface on the side of the bag mouth, the presence of the chuck causes the advantages (1), (2), and (10) to disappear, and further powder material and other fine solidified material clog the above-mentioned channel so that fitting becomes impossible.

BRIEF DESCRIPTION OF THE DRAWINGS

FIGS. 1 <A> to <M> show various projecting edge surface of bags, and are reduced in comparison with other views and have exaggerated details, FIGS. 1 <K> to <M> being inclined surface views and the others being front views. FIGS. 2 <A> to <H> are inclined surface views showing various enbmodments of bag attachment plates. FIGS. 3 <A> to <H> are inclined surface views showing various embodiments of holding devices for hold. FIGS. 4 <A> to <J> are inclined surface views showing fixed states of the edge surface of FIG. 1 and the attachment plates of FIG. 2, and FIGS. 4 <B> to <J> additionally show states where the hold is performed by the holding devices of FIG. 3. FIG. 5 and FIG. 6 are inclined surface views for reference. A part of the views of FIG. 2 to FIG. 4, and FIG. 6 show internal states with portions partially cut away. The holding devices of FIG. 3 is partially exaggerated in scale at a slight degree in comparison with those shown in FIG. 4.

BEST MODE OF CARRYING OUT THE INVENTION

In FIGS. 1 <A> to <M>, the numeral 1 denotes a bag mode of material similar to conventional material, and there is mainly shown one side of the outer surfaces of a projecting edge surface 10 made in flat form. The basic design of the bag 1 is a flat bag in FIGS. <A> to <I>, a tube bag in FIG. <J>, a bag with plait in FIG. <K>, and a bag with a bottom having angles in FIGS. <L> and <M>. The numerals 11 and 12 denote a folded edge (the numeral 111 denotes a plaited edge in FIGS. <K> and <M>) and a sealed edge (the numeral 121 denotes a back sealed edge in FIG. <F>) respectively and are both previously-provided edges since the beginning, and the numerals 13 in FIGS. <D> to <H> denote attached edges added and sealingly attached to the bag 1. The portions shown by the dot-dash lines show bag mouth level sections, and among them, the sections except the edge 12, the edge 13, or the both edges 12 and 13 are parts corresponding to a bag mouth, and the end immediately above the level section is in the form of multi-overlap in FIGS. <K> and <M> and is in the form of a single overlap in the other drawings. In FIGS. <B>, <C>, <I>, and <K> (also FIG. 2, FIG. 4, and FIG. 6), the member having a irregular dot pattern shows a thin packing 5, and is provided by suitable means such as entire surface adhesion, or partial melting fixation. The numeral 101 in FIG. <C> denotes an attachment chip concurrently serving as a packing 5 which is composed of plastic thick film chip having strong and compression elasticity, the attachment chip being fixed through thermally melting to both ends of one surface (and other surface) of the edge surface 10 and being provided with attachment holes 14 by melting cut. In FIG. <D>, the edge 12 is folded and is again sealingly fixed, and a portion of the edge 11 is fixedly overlapped by an attachment chip 101 to form an edge 13, and in the both cases, the previously-provided edges are reinforced. The bag 1 in FIG. <E> is made of strong material, and its edge 13 is provided with attachment holes 14. In FIGS. <A> and <B>, the numerals 15 and 16 provided on the edge 12 denote a cut for easy cutoff of a section 100 corresponding to cutoff and a pressed line for guided of the direction of the cutoff. The numeral 17 in FIGS. <E> and <G> denotes a cutoff edge; the numeral 171 in FIG. <K> denotes sewing machine holes able to be cut out by finger pressure; the numeral 18 in FIGS. <F> and <H> denotes a cut for a knob which makes it easy to hold and tear off the cutoff correspondence section 100; the numeral 19 in FIG. <G> denotes a cut hole for engaging a finger and also hanging, and they are provided by melting cut. The numeral 191 in FIG. <G> denotes an indication line for the discharge of a fixed quantity.

In FIGS. 2 <A> to <H>: the numeral 2 denotes a bag attachment plate made of suitable material; the numeral 200 denotes one side edge; the numeral 20 denotes a mouth end, the numeral 21 denotes a side; and the numeral 22 denotes a plate section having characteristics of contact and separation. FIGS. <A> to <E> mainly show inner surfaces, and only parts of the outer surfaces are shown in FIGS. <B>, <C>, and <E>. The details of these are as follows.

In FIG. <A>, a hard plastic sheet (or others wherein a strong plate paper having characteristics of withstanding fold and water may be used if weakness in durability is allowed) having flexible elasticity is formed merely by molding out. The plastic sheet has a shape symmetrical with respect to sewing machine holes 210 connecting the both and foldable, and has an intermediate layer composed of a foldable and flexible packing 5, and a pressure-sensitive type film-shaped layer 41 of cohesive material (or others wherein a heat-sensitive type or solvent type layer of adhesive may be used) which has a separatable paper 411 and which is laminated on the inner surface. The plate section 22 is composed of a section which has extremes defined by cuts 221 in the form of broken lines allowing foldable flexibility, and one end edge formed by a mouth end 20, and which has flexible elasticity and elastic and foldable flexibility. Its inner surface has plural recessed portions 222 in the form of grooves for inducing easy separation, the portions 222 being formed simultaneously with molding out. The advantages of the plate 2 are that the manufacture cost is low and that consumers can perform attachment.

In FIG. <B>, two formed articles have the same disign and are made of semi-hard plastic (or other semi-hard rubber), having flexible elasticity, integral hinge characteristic, and relatively hard compression elasticity. The plate section 22 is a section which has extremities composed of four folding integral hinges 223 having outer surfaces in the form of cuts, and which has one end edge composed of a mouth end 20, and further which has flexible elasticity and foldable elasticity, and the performance as a packing 5 due to its own compression elasticity. These both inner surfaces are integrally provided with projections 224 producing recessed shape for inducing characteristic of easy separation. As is the dot-dash line section 227, a projection chip, provided in a manner that the other edge of the plate section 22 forms a base in the form of a hinge, can substitute for the above-mentioned projections 224. The numerals 42 and 43 provided near the both sides 21 and 21 denote hooks and plate holes respectively, which serve as matching guides and correspond to intervals of the positions of the respective previously-mentioned holes 14 in FIG. 1 <E>, and also which have designs where they are fitted and fixed to each other. One of the advantages of this plate 2 is that consumers can perform attachment easily.

In FIG. <C>, two formed articles have hinge characteristic and the same design, and are made of hard synthetic resin. The plate section 22 is a surface-shaped section which has one end edge composed of a mouth end 20, extremities composed of four hinges 223 located near both sides and having outer surfaces provided with cuts, which includes hinges 223 at both central portions (slightly near respective one sides 21), and which has foldable characteristic, and whose both inner surface are made in the form of hollow recessed shape for inducing characteristic of easy separation. The numerals 44 and 45 provided at these both ends denote a plate end and a plate groove respectively, which have designs where they are fitted and fixed to each other. One of the advantages of this plate 2 is in easy attachment.

In FIG. <D>, a formed article has a shape symmetrical (It should be noted that positions of the both central hinges 223 provided in a shifted manner are not symmetrical. An end of one side edge 200 may have a symmetrical shape connected at the hinge texture.) with respect to integral hinge texture 211 in foldable connection and is lined at the side of the mouth end 20 with a packing 5 of foldable characteristic. Others, materials, the plate sections 22, the recessed shapes 225, or the like are similar to those of FIG. <C>.

In FIG. <E>, two hard plastic injection molded articles have the same shape and flexible elasticity (they may also be vacuum formed articles or air press formed articles made of hard plastic sheet and having flexible elasticity). The plate sections 22 are sections having flexible elasticity, and both the inner surfaces thereof have walls thinned to increase flexibility and are formed in recessed shape like a shell for inducing characteristic of easy separation. Both the mouth ends 20 have curved shape slightly recessed so that they can form a line when they contact mutually. Both the numerals 46 and 47 denote a projection and a recess for the matching guide respectively, and the numerals 48 of the both outer surfaces denote thin wall surfaces for thermally melting fixation. The advantages of this plate 2 are that a considerable quantity of the contents can be accommodated in the resecced shape 226 and that the inner surfaces thereof have characteristic of self separation.

In FIG. <F>, it is made by cutting vertically an extrusion molded article made of hard plastic and having elastic hinge characteristic and thin walls, and the shape of the cut surface is symmetrical with respect to the hinge texture 211. The plate sections 22 are surface sections having elastic foldable characteristic and are the plate 2 in it self. When pressure is released, the inner surfaces thereof essentially return to states having a foldable recessed shape as shown. The entire inner surfaces thereof are coated with packing 5 and heat-sensitive adhesive 49 in turn in the form of layers. the advantages of this plate 2 are that the manufacture cost is low and that it has characteristic of self separation.

In FIG. <G>, an injection molded article made of semi-hard plastic has flexible elasticity, hinge characteristic, thin walls, and a shape symmetrical with respect to a hinge texture 211. The plate section 22 is composed of the plate 2 itself which has flexible elasticity, and is similar to that of FIG. <F> in performance and others except that the inner surface thereof has flexible recessed shape. Both sides 21 and 21 oppose in the perpendicular directions, and the numerals 212 denote recesses for engaging fingers.

In FIG. <H>, it is basically similar to the plate 2 of FIG. <F> except that both end hinges are folded inward, and that central hinges 223 and a cut 213 for a hinge texture are provided.

In FIGS. 3 <A> to <H>, the numerals 3 denote holding devices for hold which have stiffness, and the numerals 30 denote inner wall narrow portions. The holding device in FIG. <H> is made of metal leaf spring material, and the others are injection molded articles made of suitalbe hard synthetic resin. In FIG. <C>, a main body may be made by cutting an extrusion molded article. Although not shown, other may be performed in which stick spring material forms a pinch cock design.

FIGS. 4 <A> to <J> show conditions where the plates 2 of FIG. 2 and the edge surfaces 10 of FIG. 1 are attached to each other. FIGS. <A>, <C>, <E>, <G>, and <I> also show conditions where the inner surfaces of the plate sections 22 are separated, and FIGS. <B> and <J> also show conditions where the hold is performed by the holding device 3. The cutoff correspondence portion 100 is shown only in FIG. <J>, and is omitted from the other drawings for convenience sake. The details of these are as follows.

In FIG. <A>, the plate 2 of FIG. 2 <A> from which the separatable paper 411 was stripped is folded double along the sewing machine holes and is wholly pressed against the outer surface of the edge surace 10 of FIG. 1 <A> to perform cohesion. The cohesive layer 41 (or adhesive layer) may be applied to the edge surface 10. In addition, the separatable paper 411 and the cohesive layer 41 may be eliminated and the area of the fixation of the plate 2 may be limited to an end region from the respective sides 21 to the respective holes 221 to perform spot melting fixation. When both the sides 21 are mutually pressed, the inner surfaces of the plate 22 are separated in curved shape with extremities composed of the cut holes 221 as shown.

In FIG. <C>, respective one hooks 42 of FIG. 2 <B> were passed through the respective holes 14 of FIG. 1 <E>, and respective other plate holes 43 were pressed into the hooks 42 to perform fitting attachment. When both the sides 21 are mutually pressed, separation in curved shape is induced as shown. After the press is released, a slight curve remains in the other edge of the plate section 22 as shown in FIG. 4 <D>, since the projections 224 contact each other. Although not shown, the both hooks 42 may be eliminated and changed to the plate holes 43, and these plate holes 43 are mutually attached by clamping devices, such as snaps, eyelets, and rivets. Furthermore, the plate holes 43 may be eliminated to form flat portions, and these flat portions and the edges 13 may be connected to each other by adhesive, both surface adhesive tape, or welding, and may be connected to each other by staples or sewed to each other with sewing string in the case of the plate 2 made of material having adequate holing property. In the case where the inner surface of the plate section 22 contacts the edge 13 (and the edge 12) as in the plate 2 of this drawing, it is necessary to prevent direct connection between the edge and the inner surface, since smooth separation of the plate section 22 is obstructed.

In FIG. <E>, after both the edges 12 of FIG. 1 <B> are located at the inner surfaces of both ends of one plate 2 of FIG. 2 <C>, one plate ends 44 of the both plates 2 are fitted into the respective other plate grooves 45 to perform fitting attachment. When the both sides 21 are pressed mutually, the respective hinges 223 are folded and the inner surfaces of the plate section 22 are separated. Folding in the opposite direction is prevented, because of the positional deviation between the both central hinges 223.

In FIG. <F>, adhesive was applied to the W-shaped inner surface of the plate 2 except the recessed shape 225 of FIG. 2 <D>, and the plate 2 which was folded double along the hinge texture 211 is pressed against the edge surface 10 of FIG. 1 <F> to perform adhesion.

In FIG. <G>, the edge surface 10 of FIG. 1 <I> was located between the both inner surfaces of the plate 2 of FIG. 2 <E> and respective one projections 46 were moved into respective other resecces 47, and after the edge surface 10 was given a margin which allows the bag mouth thereof to be made flat properly after fixation, the thin wall surfaces 48 were melted and fixed to each other by melting (The broken line portion in FIG. 1 <I> shows a melting fixed portion). During the release of the pressure, the inner surface of the plate section 22 essentially returns to a flexible recessed shape as shown. The respective thin wall surfaces 48 may be changed to through holes and be engaged with the edge surface 10, and these respective holes may be connected by melting process using fusible rivets.

In FIG. <I>, the edge surface 10 of FIG. 1 <J> was located between the both inner surfaces of the plate 2 of FIG. 2 <F>, and the connection was performed through pressure extension and development connection from the hinge texture 211 in heated ambient air or under a heated nip roll. During the release of the pressure, the inner surface of the plate section 22 essentially returns to an elastic and foldable recessed shape as shown. The edge surface 10 adapted to this plate 2 must have both edges 11 mutually parllel, and the distance therebetween must equal the distance between the connection inner surfaces of the plate 2 (in the plate 2 of FIG. 2 <H>, this limitation can be ignored, and the connection part is not limited only to the both sides 21). As the connection in FIG. <G>, partial connection may be made while the edge surface 10 is given a margin.

In FIG. <J>, the plate 2 of FIG. 2 <G> and the edge surface 10 (the folded edge 11 is perpendicular) of FIG. 1 <L> were connected via development connection similar to that in FIG. <I>, and the inner surface of the plate 22 essentially returns to a flexible recessed shape.

In FIG. 1 <K> or <M> where the end immediately above the bag mouth level section is in the form of multi-overlap, for the connection, it is necessary that the outer surfaces of the overlapped plaited edge 111 were connected to each other beforehand or an attachment device (for example, the plate 2 and the multi-overlap surface were connected together by melting) for preventing the shift of the overlap was used to change the multi-overlap to a single ovelap.

The holding devices 3 of FIG. 3 adapted to the connected plates 2 are as follows.

As shown in FIG. <A> in FIG. 4 <A> and FIG. 4 <B>, they are mouted. The plate 2 and the holding device 3 are provided with projections 23 and side holes 31 respectively which serve as stoppers and which can engage each other, and the holding device 3 is engaged during the mounting.

In FIG. <B> in FIG. 4 <C>, this hold state is diagrammatically shown by the dot-dash line in FIG. <D>. The plate 2 and the holding device 3 are provided with a stake 24 and a slot 32 respectively which are arranged to be engageable with each other.

In FIGS. <C> or <H> in FIG. 4 <E>, the plate 2 and the holding device 3 of FIG. <C> are provided with a hole 25 and a lump 34 having engagement line 33 respectively which are arranged to be able to fit to each other, so that the both can be connected.

In FIG. <D> in FIG. 4 <F>, the hold state is diagramatically shown by the dot-dash line in FIG. <F>. The plate 2 and the holding device 3 are provided with a projection 26 and and an axis hole 27, and a latch 35 and a support axis 36 respectively which are arranged to be engageable with and pivotally supportable on each other, so that the holding device 3 can be rotatably connected and engaged.

in FIG. <E> in FIG. 4 <G>, the hold state is shown by the dot-dash line in FIG. <H>. The plate 2 and the holding device 3 are provided with support axes 28 and holes 37 respectively which are arranged to be pivotally supportable on each other, so that the rotatable connection is obtained.

The plate 2 of FIG. 4 <I> or the connected plate 2 of FIG. 2 <H> is provided with as in FIG. <F> (or <H>) or <H>, and the holding device 3 of FIG. <F> is integrally provided with pocket and knob 38 for accommodating a butter knife or other tool.

The connected plate 2 of FIG. 2 <G> is provided in FIG. <G> with the hold as shown in FIG. 4 <J>. The plate 2 and the holding device 3 are provided with a projection 29 and a recess 39 respectively which serve as a stopper and which are arranged to be engageable with each other. Since the end 300 of the holding device 3 is given a margin which enables accommodation of the double folded cutoff correspondence section 100, the hold can be performed during transportation and adequate dust prevention is offered to the bag mouth surface and the mouth end 20. In FIG. 4 <J>, the numerals 71 and 72 denote a portoin of packing carton and a flap of a window opening respectively which are shown for references.

In FIG. 5, the numeral 73 denotes a sheath bag made of plastic which is shown for reference. As shown, a tool 74 (a butter knife as an example) is covered with this sheath bog 73 and then the double fold along the dot-dash line is perfomed. Thereafter when it is accommodated in the pocket knob 38 of FIG. 3 <F>, the interIor of the pocket 38 and the tool 74 are isolated so that it is effective in sanitation and in prevention of adhesion to the holding device 3 and hands and fingers.

FIG. 6 shows an embodiment for reference in which consumers can attach the plate 2 easily. Specifically, a packing 5 in the form of a distorted circle is placed on the both outer surfaces of the edge surface 10 immediately above the section corresponding to the bag mouth level, and after the outer surfaces thereof are coated with a plastic small bag 6 (serving also as the attached chip 101) accommodating the hooks 42 and the plate 2 having the plate holes 4 and further the holding device 3, both the inner surfaces and outer surfaces of the edge surface 10, both the inner surfaces of the small bag 6, and the inner surfaces and the outer surfaces of the packing 5 at both ends are simulteneously fixed in an open U-shape by thermally melting. Both sides of the bag 6 are provided with engagement holes 14 and cuts 15 which are formed by melting cut, and with press lines 16.

INDUSTRIAL APPLICABILITY

It is apparent that the device of this invention does not involve any difficulty in manufacture at industrial scale, because of its simple design and mediocrity in material and manufacture. There is no difficulty in attachment to a bag (specifically, automatic attachment is possible prior to and after the charge of the contents, and for example, it is sufficient that the base of the edge surface is held and pressed by a holding arm for transportation of bags beforehand and thus the charge to the attachment portion is prevented), and further there is no limitation on the contents (accordingly, additional necessary restriction allows adaptation to liquid material, and for example, the application of a packing, the use of a self supporting bag, or the offer of standing characteristic to a bag makes it possible). Accordingly, there is no question on the industrial applicability of the device of this invention, and when it is carried out, consumers can receive various conveniences unavailable heretofore.

I claim:

1. A bag mouth opener for a bag sealed after charge of contents and made of flexible packing material having a thin wall, the opener comprising a bag attachment device attached along and immediately above an assumed bag mouth level portion on both outer surfaces of a flat projecting edge surface of the bag, said attachment device including a combination of a bag attachment plate and a holding device said attachment plate having a pair of side edges longer than a bag mouth correspondence section of said level portion, a pair of mouth ends provided to said edges, a pair of extremities of both sides of said plate, a pair of plate sections with characteristics of contact and separation and in a region of the plate including the mouth ends and the both extremities, and sides on both ends, the attachment plate having said elements as major components and having an integral structure, said pair of the mouth ends having thin walls and having design such that the mouth ends easily match each other and inner surfaces thereof contact each other, suitable material of the plate being so-called easily handleable molding material such as synthetic resin or fold-withstanding and water-withstanding paper which is safe in touching peripheral edges of said molding and which has stiffness with characteristic of maintaining shape, molded sections having locally thin walls on both sides of the plate, sections wholly taking form of elongated thin plates and stopped by edges of said edge surface during attachment, that is, said extremities, being made of material and having design such that these extremities repeatedly fold in the form of lines during each press from said both sides, the above-mentioned pair of the plate sections, under conditions where the mouth ends mutually match and inner surfaces of the plate oppose each other, being made of material and having design such that inner surfaces of the plate sections separate from each other during said folding of the extremities by the press and at least inner surfaces on side of the mouth ends contact each other as a result of pressing action from the both plate sections and pulling action toward the both sides, that is, counter action with respect to said press, the above-mentioned holding device being allowed to be made of material with stiffness and having design such that one end of upper wall and one end of lower wall which form said inner wall narrow portions are closed and other ends thereof are open, an interval between at least part of inner walls of these open upper and lower end edges being greater than thickness of mouth end portions in contact through the edge surface so that the mouth end portions can be easily inserted thereinto, an interval between said narrow portions being smaller than thickness of the both plate sections so that states of the plate sections in closing contact through the edge surface can be maintained, and suitable attaching means having no need for use again and being operative for attachment in such a manner that under conditions where the plate is arranged in opposed manner with the mouth ends located along said bag mouth correspondence sections at least parts of respective inner surfaces extending from the respective extremities thereof to the side districts overlap with sections of edges of the edge surface provided to said parts and that said contact and separation characteristics of the plate sections are not obstructed.

* * * * *

UNITED STATES PATENT AND TRADEMARK OFFICE

CERTIFICATE OF CORRECTION

PATENT NO. : 4,753,489

DATED : June 28, 1988

INVENTOR(S) : Junji MOCHIZUKI

It is certified that error appears in the above-identified patent and that said Letters Patent is hereby corrected as shown below:

On the the title page,

After "[21] Appl. No.: 2,406" insert the following:

| | | |
|---|---|---|
| --[22] | PCT Filed: | April 13, 1985 |
| [86] | PCT No. | PCT/JP85/00196 |
| | 371 Date: | December 12, 1986 |
| | 102(e) Date: | December 12, 1986 |

Delete "[22] Filed: Dec. 12, 1986"

Signed and Sealed this

Twenty-second Day of November, 1988

*Attest:*

*Attesting Officer*

DONALD J. QUIGG

*Commissioner of Patents and Trademarks*